US005970293A

United States Patent [19]

Huang

[11] Patent Number: 5,970,293

[45] Date of Patent: Oct. 19, 1999

[54] DEVELOPER CONTAINER FOR USE WITH A DEVELOPER REPLENISHING DEVICE

[75] Inventor: Ya-Li Huang, Taichung County, Taiwan

[73] Assignee: General Plastic Industrial Co., Ltd., Taichung County, Taiwan

[21] Appl. No.: 09/240,200

[22] Filed: Jan. 29, 1999

[51] Int. Cl.[6] ..... G03G 15/08

[52] U.S. Cl. ..... 399/262; 399/119; 222/DIG. 1

[58] Field of Search ..... 399/262, 263, 399/260, 258, 119, 120; 222/DIG. 1

[56] References Cited

U.S. PATENT DOCUMENTS

| | | | |
|---|---|---|---|
| 5,528,349 | 6/1996 | Satake . | |
| 5,630,198 | 5/1997 | Makino | 399/120 |
| 5,678,147 | 10/1997 | Makino | 399/263 |
| 5,722,014 | 2/1998 | Fike | 399/119 |
| 5,740,507 | 4/1998 | Ichikawa et al. | 399/262 |
| 5,771,427 | 6/1998 | Makino | 399/120 |
| 5,774,773 | 6/1998 | Otsuka et al. | 399/262 |
| 5,794,107 | 8/1998 | Russell | 399/262 |
| 5,794,108 | 8/1998 | Yoshizawa et al. | 399/262 |
| 5,867,757 | 2/1999 | Okazaki et al. | 399/262 |
| 5,890,034 | 3/1999 | Nakano et al. | 399/262 X |
| 5,890,040 | 3/1999 | Matsuoka et al. | 399/262 |
| 5,903,806 | 5/1999 | Matsuoka et al. | 399/258 |
| 5,907,756 | 5/1999 | Shirota et al. | 399/262 |
| 5,909,610 | 6/1999 | Yoshiki et al. | 399/262 |

*Primary Examiner*—Richard Moses
*Attorney, Agent, or Firm*—Pro-Techtor International Services

[57] ABSTRACT

A developer container includes a container body having a front opening, and a developer dispensing outlet near the front opening, a propelling member suspended in the container body and rotated to propel a developer out of the developer dispensing hole, and a rotary cover covered on the front opening of the container body and secured in place upon installation of the developer container in a copier for enabling the container body to be rotated relative to the rotary cover to close/open the developer dispensing outlet, wherein the container body has a sliding groove for guiding rotary motion of the container body relative to the rotary cover, and a rib for engagement with a rib at the rotary cover to stop the container body from rotary motion relative to the rotary cover; the rotary cover has a cover flange for closing the developer dispensing outlet, a guide plate matched with the sliding groove at the front end of the container body, and a rib raised from the guide plate for engagement with the rib in the sliding groove at the front end of the container body.

2 Claims, 4 Drawing Sheets

DEVELOPER CONTAINER FOR USE WITH A DEVELOPER REPLENISHING DEVICE

BACKGROUND OF THE INVENTION

The present invention relates to a developer container for use with a developer-replenishing device in a copier, facsimile apparatus, printer or similar electrophoto-graphic image forming apparatus.

A developer container for use with a developer replenishing device in for example, a copier is generally comprised of a container body holding a developer, a rotary cover covered on the container body, a propelling member suspended in the container body and extended out of one end of the container body for turning by a driving mechanism in the copier to propel the developer out of a developer dispensing outlet at the container body. The copier for use with this structure of developer container has rotary holder means designed to receive the developer container. When a developer container is installed in the copier, the container body of the developer container is rotated in one direction to open the developer dispensing outlet, enabling the contained developer to be propelled out of the developer dispensing outlet upon an operation of the copier. This rotary holder means has a complicated structure, and is inexpensive to manufacture. Furthermore, this rotary holder means tends to be damaged during installation of a developer container.

SUMMARY OF THE INVENTION

The present invention has been accomplished to provide a developer container for use with a copier, which eliminates the aforesaid problems. According to the present invention, the developer container comprises a container body, and a rotary cover covered on one end of the container body and rotated relative to the container body. The rotary cover has a positioning block for positioning in the copier for enabling the container body to be rotated relative to the rotary cover to open/close its developer-dispensing outlet. The container body has a sliding groove, for guiding rotary motion of the container body relative to the rotary cover, and a rib for engagement with a rib at the rotary cover to stop the container body from rotary motion relative to the rotary cover, enabling the developer dispensing outlet to be maintained closed by the rotary cover.

DETAILED DESCRIPTION OF THE PREFERRED EMBODIMENT

Figure 1:
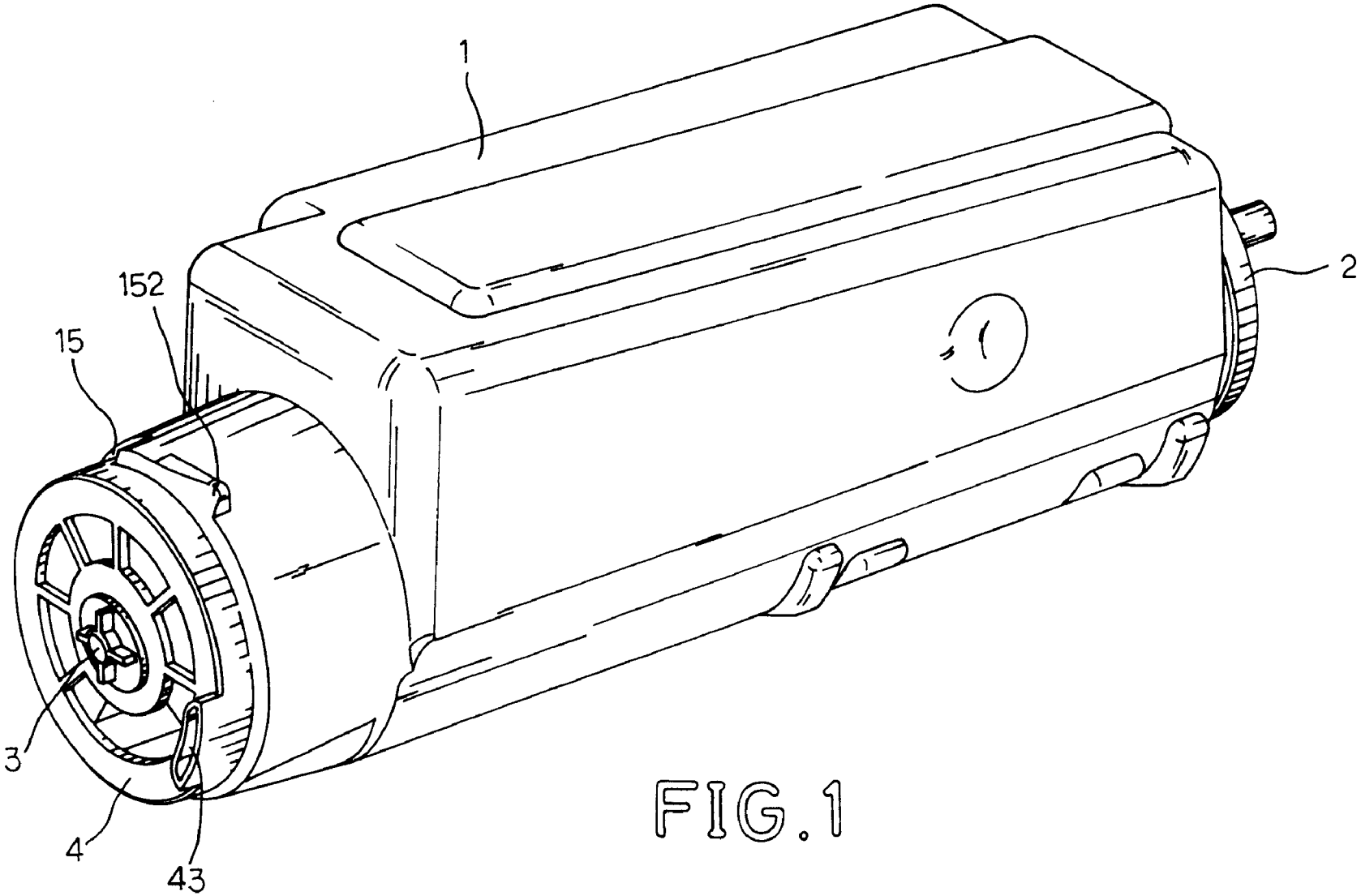
FIG. 1 is a perspective view of a developer container according to the present invention.

Referring to FIGS. from 1 through 4, a developer container is shown comprises a container body 1. The container body 1 has a front opening 13 at its front end, a rear opening 11 at its rear end through which developer is filled into the container body 1, a sliding groove 15 around the periphery of its front end, a developer dispensing outlet 14 at the periphery of its front end in communication with the front opening 13, a locating block 152 raised from the periphery at its front end, and a rib 151 raised in the sliding groove 15 near the locating block 152. A rear cap 2 is covered on the rear opening 11 at the container body 1. A propelling member 12 is suspended in the container body 1, having one end extended out of the front opening 13 of the container body 1. A gear wheel 3 is fixedly mounted on one end of the propelling member 12 outside the container body 1, and coupled to rotary drive means (not shown) in the copier 10. When the rotary drive means of the copier 10 is started, the propelling member 12 is rotated with the gear wheel 3 to stir up developer in the container body 1.

Figure 2:
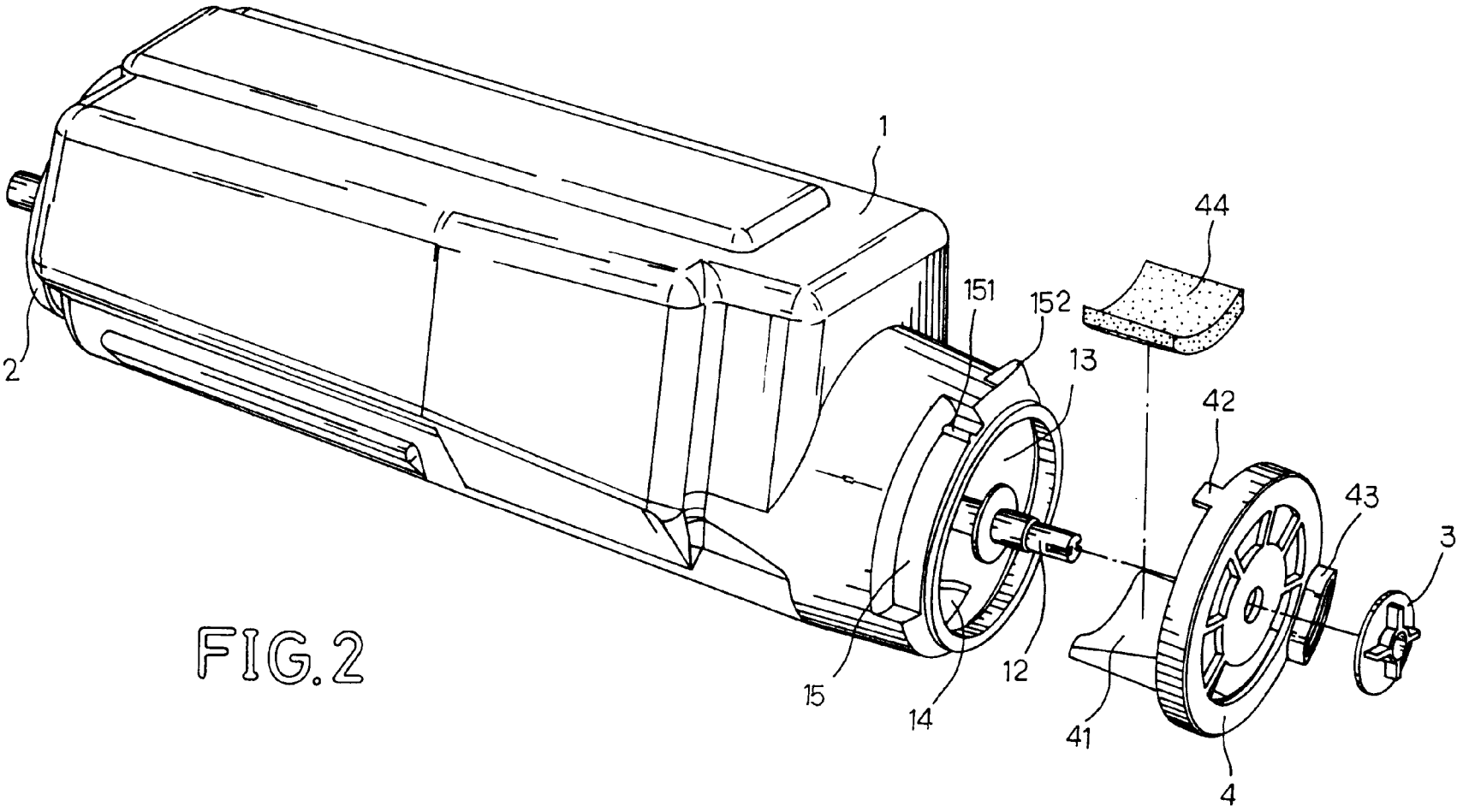
FIG. 2 is an exploded view of the developer container shown in FIG. 1.
Figure 3:
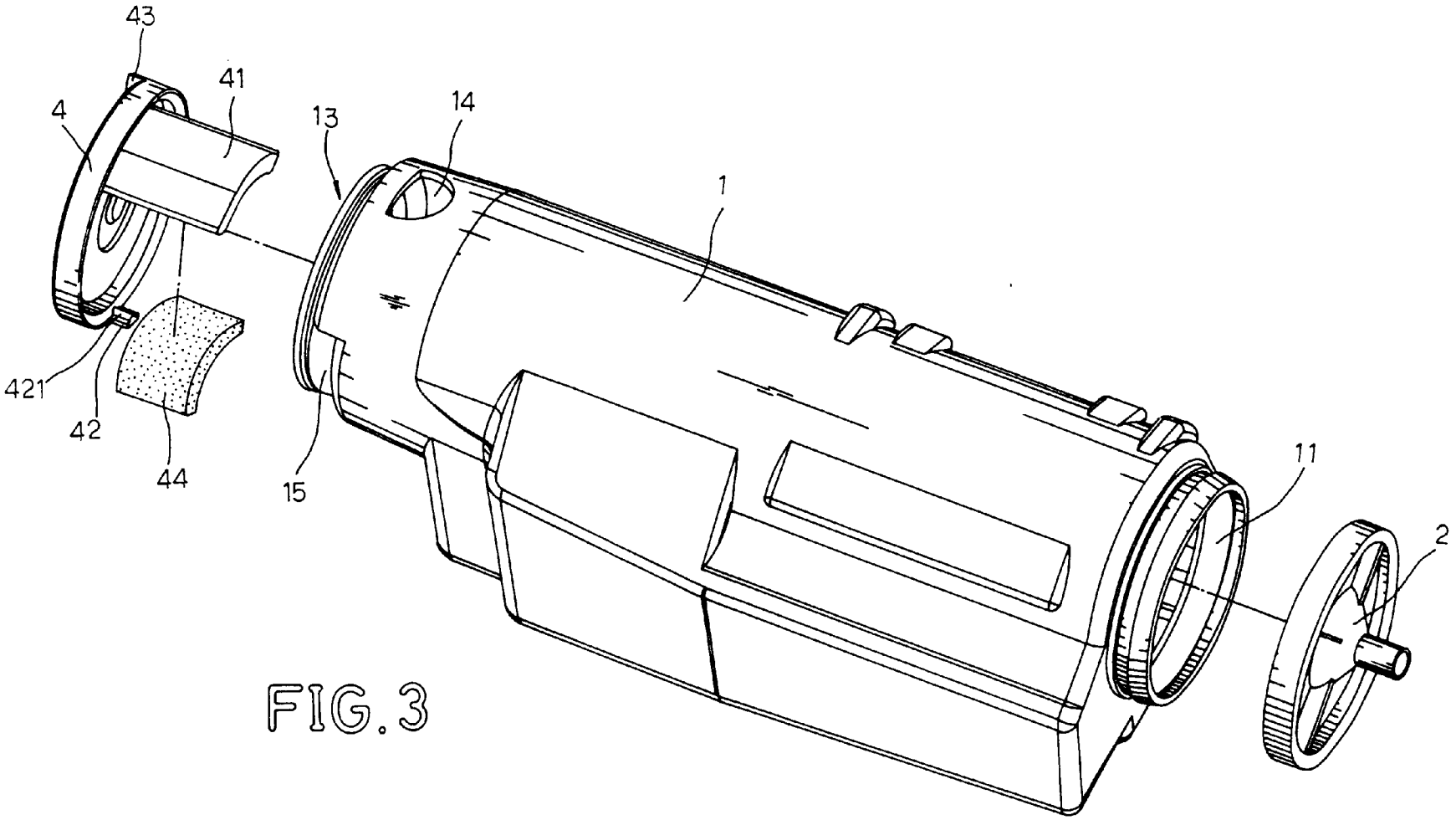
FIG. 3 is another exploded view of the developer container shown in FIG. 1 when viewed from another angle.
Figure 4:
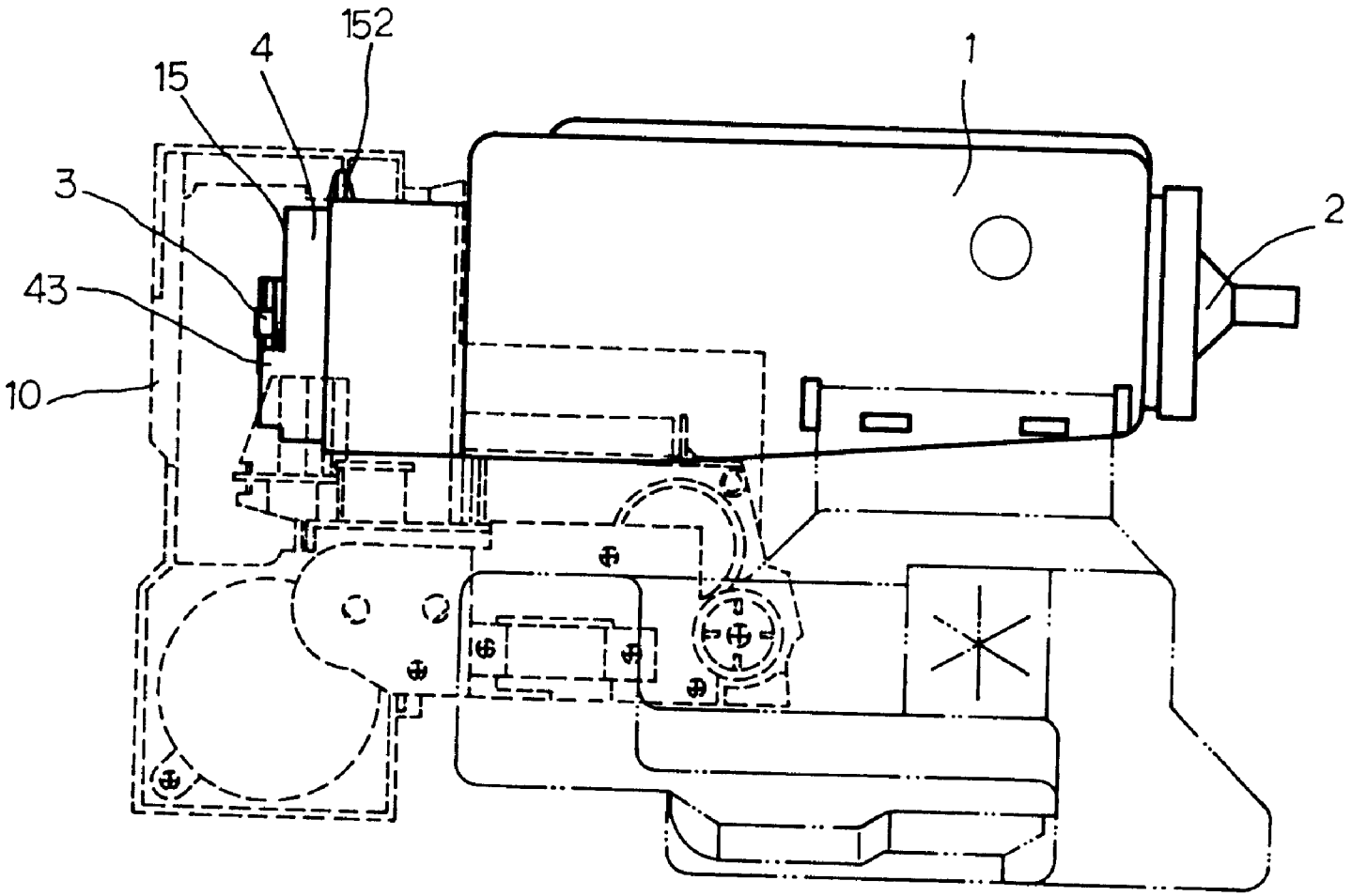
FIG. 4 is a side view showing the developer container installed in a copier according to the present invention.

Referring to FIGS. 2 and 3 again, a rotary cover 4 is mounted around the propelling member 12 and covered on the front opening 13, and rotated relative to the container body 1 to close/open the developer dispensing outlet 14. The rotary cover 4 comprises a guide plate 42, and a cover flange 41 bilaterally downwardly extended from its bottom side wall, a rib 421 raised from the guide plate 42 at an inner side, a sponge lining 44 adhered to the cover flange 41 at an inner side, and a positioning block 43 raised from its top side wall near its periphery.

Referring to FIGS. from 1 through 4 again, when the rotary cover 4 is covered on the front opening 13 of the container body 1, the cover flange 41 is suspended in the container body 1, and the guide plate 42 is extended in the sliding groove 15. When the developer container is installed in the copier 10, the positioning block 43 is forced into engagement with retainer means in the copier 10. After installation, the container body 1 is rotated in one direction relative to the rotary cover 4 (the rotary cover 4 is held down by retainer means in the copier 10), enabling the rib 151 to be moved with the container body 1 away from the rib 421 at the guide plate 42. When one end of the sliding groove 15 is stopped at the guide plate 42, the developer dispensing outlet 14 is moved, away from the cover flange 41, for enabling developer to be propelled out of the developer dispensing outlet 14 by the propelling member 12, and the locating block 152 is positioned in the copier 10, causing the container body 1 to be firmly secured in place.

When taking the developer container out of the copier 10, the container body 1, is rotated relative to the rotary cover 4 in the reversed direction, enabling the rib 151 to be moved with the container body 1 over the rib 421 at the guide plate 42 (because the material of the rotary cap 4 has springy power, the rib 151 can be moved with the container body 1 over the rib 421 at the guide plate 42 by force). When moving over the rib 421, the rib 151 becomes engaged with the rib 421. The developer dispensing outlet 14 is closed, by the cover flange 41 of the rotary cover 4 upon engagement of the rib 151 with the rib 421, and the developer container can then be taken out of the copier 10 after disengagement of the positioning block 43 from the retainer means in the copier 10.

While only one embodiment of the present invention has been shown and described, it will be understood that various modifications and changes could be made thereunto without departing from the spirit and scope of the invention disclosed.

What the invention claimed is:

1. A developer container comprising a container body holding a developer, said container body comprising a front end, a rear end, a developer filling hole at said rear end, a front opening at said front end, and a developer dispensing outlet at the periphery of said front end in communication with said front opening; a rear cover covered on said developer filling hole at said container body; a rotary cover covered on the front opening of said container body, and a propelling member suspended in said container body and extended out of a hole at said rotary cover and rotated to propel said developer out of said container body through said developer dispensing outlet; wherein:

said container body comprises a sliding groove around the periphery of said front end, a locating block raised from the periphery of said front end for positioning in a copier, and a rib raised in said sliding groove;

said rotary cover is secured in place after installation of the developer container in a copier, enabling said container body to be rotated relative to said rotary cover between a first position where said developer dispensing outlet is closed by said rotary cover, and a second position where said developer dispensing outlet is opened from said rotary cover for letting said developer be propelled out of said container body by said propelling member, said rotary cover comprising a downwardly extended guide plate moved with said rotary cover along the sliding groove at the periphery of the front end of said container body, a downwardly extended cover flange inserted into the front opening of said container body and moved with said rotary cover between said first position and said second position to close/open said developer dispensing outlet, a rib raised from said guide plate at an inner side and moved with said guide plate into engagement with the rib at said sliding groove at said container body upon rotary motion of said rotary cover on the front end of said container body, and a positioning block raised from a top side wall for positioning in the copier.

2. The developer container of claim 1 wherein said cover flange of said rotary cover has an inner side wall securely covered with a sponge lining.

* * * * *